US012139894B2

(12) United States Patent
Huang et al.

(10) Patent No.: US 12,139,894 B2
(45) Date of Patent: Nov. 12, 2024

(54) MAGNETIC PULL-OUT FAUCET

(71) Applicant: Yongqiang Yan, Fujian (CN)

(72) Inventors: Lengjie Huang, Fujian (CN); Pingqing Zhang, Xiamen (CN); Haihua Su, Fujian (CN); Changzheng Ni, Xiamen (CN)

(73) Assignee: Yongqiang Yan, Xiamen (CN)

( * ) Notice: Subject to any disclaimer, the term of this patent is extended or adjusted under 35 U.S.C. 154(b) by 326 days.

(21) Appl. No.: 17/682,984

(22) Filed: Feb. 28, 2022

(65) Prior Publication Data

US 2023/0193604 A1 Jun. 22, 2023

(30) Foreign Application Priority Data

Dec. 17, 2021 (CN) ..... 202123195872.2

(51) Int. Cl.
*E03C 1/04* (2006.01)

(52) U.S. Cl.
CPC ..... *E03C 1/0404* (2013.01); *E03C 1/041* (2013.01); *E03C 2001/0415* (2013.01); *E03C 2001/0418* (2013.01)

(58) Field of Classification Search
CPC ..... E03C 1/0404; E03C 1/041; E03C 2001/0415; E03C 2001/0418; Y10T 137/9464
See application file for complete search history.

(56) References Cited

U.S. PATENT DOCUMENTS

D733,259 S * 6/2015 Flowers ..... D23/238
2013/0019974 A1* 1/2013 Laera ..... E03C 1/0404 137/801
2015/0308088 A1* 10/2015 Enlow ..... E03C 1/0404 137/1
2016/0215482 A1* 7/2016 Fourman ..... E03C 1/0404
2019/0003162 A1* 1/2019 Fourman ..... F16K 19/006

FOREIGN PATENT DOCUMENTS

CN 101479432 A * 7/2009 ..... E03C 1/04
WO WO-2004092626 A1 * 10/2004 ..... E03C 1/0404

* cited by examiner

*Primary Examiner* — Patrick C Williams

(57) ABSTRACT

The present utility model provides a magnetic pull-out faucet including a faucet body, a faucet support bracket, and a water supply hose movable in the faucet body and the faucet support bracket. A hose connector is disposed on a front end of the water supply hose and connected with a water outflow pull head. The faucet support bracket is provided with a cross rod, the cross rod is provided with a first magnetic attraction element. The hose connector is provided with a second magnetic attraction element. The first magnetic attraction element is a magnet having a magnetism, and the second magnetic attraction element is a magnet with a magnetism opposite to the first magnetic attraction element or an iron element magnetizable by the first magnetic attraction element. The cross rod is mated with the hose connector in a magnetic attraction manner.

6 Claims, 5 Drawing Sheets

MAGNETIC PULL-OUT FAUCET

CROSS-REFERENCE TO RELATED APPLICATION

The present application is based on, and claims priority from, Chinese application number CN202123195872.2, filed Dec. 17, 2021, the disclosure of which is hereby incorporated by reference herein in its entirety.

TECHNICAL FIELD

The present utility model relates to the field of kitchen pull-out faucets, and in particular to a magnetic pull-out faucet.

BACKGROUND

A pull-out faucet is detachably mounted on a fixed faucet body, and a telescoping water supply hose is connected to a water outflow pipe of the fixed faucet body and then connected to a water outflow pull head which can be pulled out for flexible use in a given scope. In the prior arts, the water supply hose is fitted into an annular connector on a faucet body support bracket so as to achieve the returning and positioning of the water outflow pull head. These operations involve a fixed pull angle, high accuracy of hand actions, and may be inconvenient, and is therefore particularly not suitable for old persons, children and disabled persons incapable of accurately making positioning actions. The object of the present utility model is to provide a magnetic pull-out faucet so as to solve the aforementioned problems.

SUMMARY

In order to achieve the above purpose, the present utility model provides the following technical solution.

There is provided a magnetic pull-out faucet, including a faucet body, a faucet support bracket fixed on the faucet body and a water supply hose movable in the faucet body and the faucet support bracket. A hose connector is disposed on a front end of the water supply hose and connected with a water outflow pull head. The faucet support bracket is provided with a cross rod and the cross rod is provided with a first magnetic attraction element. The hose connector is provided with a second magnetic attraction element. The first magnetic attraction element is a magnet having a magnetism. The second magnetic attraction element is a magnet with a magnetism opposite to the first magnetic attraction element or an iron element magnetizable by the first magnetic attraction element. The cross rod is mated with the hose connector in a magnetic attraction manner.

As a preferred or optional implementation, the first magnetic attraction element is thread-mated with the cross rod.

As a preferred or optional implementation, a first groove is disposed in a middle portion of the first magnetic attraction element, and a thread hole is disposed at a bottom of the first groove, and a rubber pad is embedded inside the first groove.

As a preferred or optional implementation, a support seat is disposed between the first magnetic attraction element and the cross rod, and the support seat is thread-mated with the first magnetic attraction element and the cross rod.

As a preferred or optional implementation, a second groove is disposed in the hose connector, the hose connector is connected with the cross rod through the second groove, and an opening angle of the second groove relative to a horizontal direction is 0-10 degrees.

As a preferred or optional implementation, the second magnetic attraction element is disposed inside the second groove, a thread hole is disposed at a bottom of the second groove and the second magnetic attraction element respectively, and the second magnetic attraction element is thread-mated with the hose connector.

As a preferred or optional implementation, a hydraulic generator and a temperature sensing element are disposed inside the water outflow pull head.

As a preferred or optional implementation, an LED lamp is further disposed inside the water outflow pull head.

Compared with the prior arts, the present utility model has the following beneficial effects.

(1) In the present utility model, the first magnetic attraction element is disposed on the cross rod of the faucet support bracket, the second magnetic attraction element is disposed on the hose connector, and the cross rod and the hose connector are mutually mated through magnetic attraction of the two magnetic attraction elements. Under the magnetic attraction, an operator does not need to make accurate action but move the hose connector close to the cross rod when returning and positioning the water outflow pull head. In this way, the returning and positioning of the water outflow pull head can be achieved. Further, when the water outflow pull head is pulled out for use, it is not limited by a fixed angle, bringing simple operation and convenience. Particularly, the present invention is suitable for old persons, children, and those disabled persons incapable of making fine actions.

(2) The hydraulic generator, the temperature sensing element and the LED lamp are disposed inside the water outflow pull head. Water flow in the water outflow pull head passes through the hydraulic generator to provide power to the LED lamp, and the temperature sensing element senses temperatures of the water flow and makes the LED lamp emit different colors, so as to present water flows of different colors to a faucet operator. The faucet operator may determine whether the temperature of the water is high or not based on the color of the water flow, thus reducing the chance of high temperature scalding and achieving more comfortable and safer use experiences to the faucet operator.

BRIEF DESCRIPTIONS OF THE DRAWINGS

Numerals of the drawings are described below:

10—faucet body;

20—faucet support bracket, 21—cross rod, 211—first magnetic attraction element, 212—rubber pad, 213—support seat;

2111—first groove;

30—water supply hose, 31—hose connector, 311—second magnetic element, 312—second groove;

40—water outflow pull head, 41—hydraulic generator; and

50—screw.

DETAILED DESCRIPTIONS OF EMBODIMENTS

The technical solution of the embodiments of the present utility model will be clearly and fully described below in combination with accompanying drawings in the embodiments of the present utility model. Apparently, the described embodiments are merely some embodiments of the present utility model rather than all embodiments. Other embodiments obtained by those skilled in the art based on these embodiments of the present utility model without making creative work shall fall within the scope of protection of the present utility model.

First Embodiment

Figure 1:
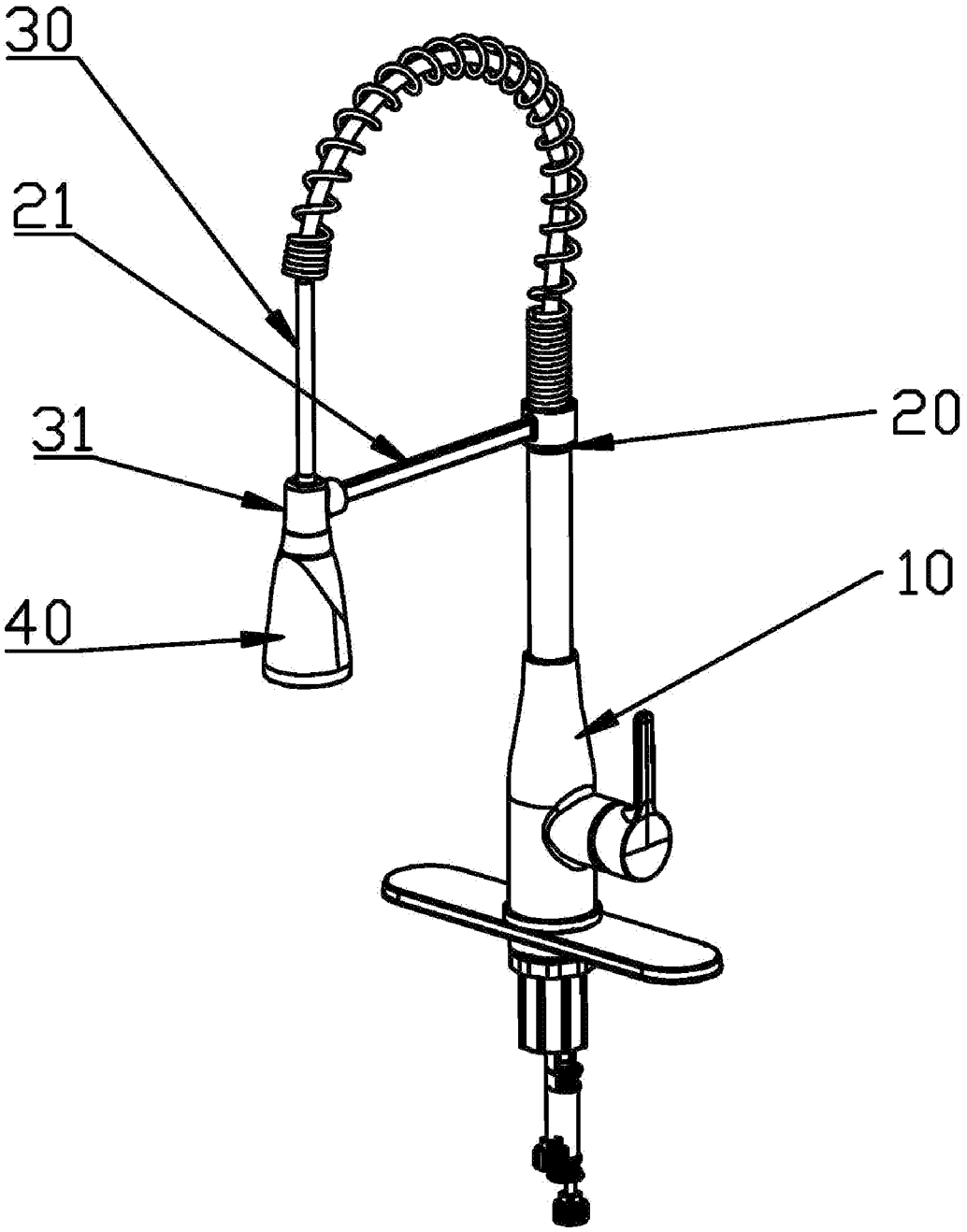
FIG. 1 is a schematic diagram illustrating an entire structure of the present utility model.

With reference to FIG. 1, a magnetic pull-out faucet in the first embodiment of the present utility model includes a faucet body 10, a faucet support bracket 20 fixedly assembled on the faucet body and a water supply hose 30 which is mounted in the faucet body 10 and the faucet support bracket 20 in a penetration manner and capable of being pulled out and moved rotatably. A hose connector 31 is mounted at a front end of the water supply hose 30 and connected to a water outflow terminal, i.e. a water outflow pull head 40.

Figure 2:
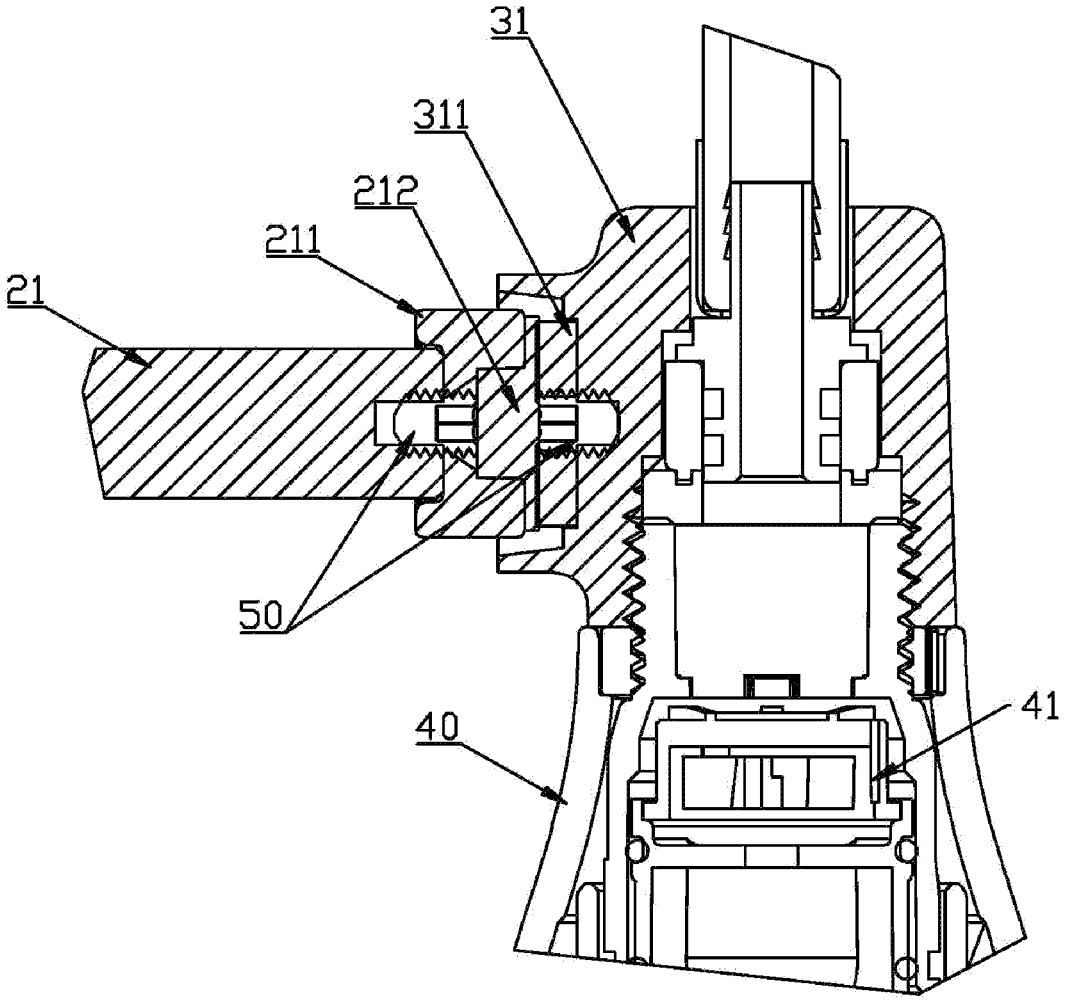
FIG. 2 is a sectional schematic diagram illustrating a water outflow pull head in a returned state according to a first embodiment of the present utility model.
Figure 3:
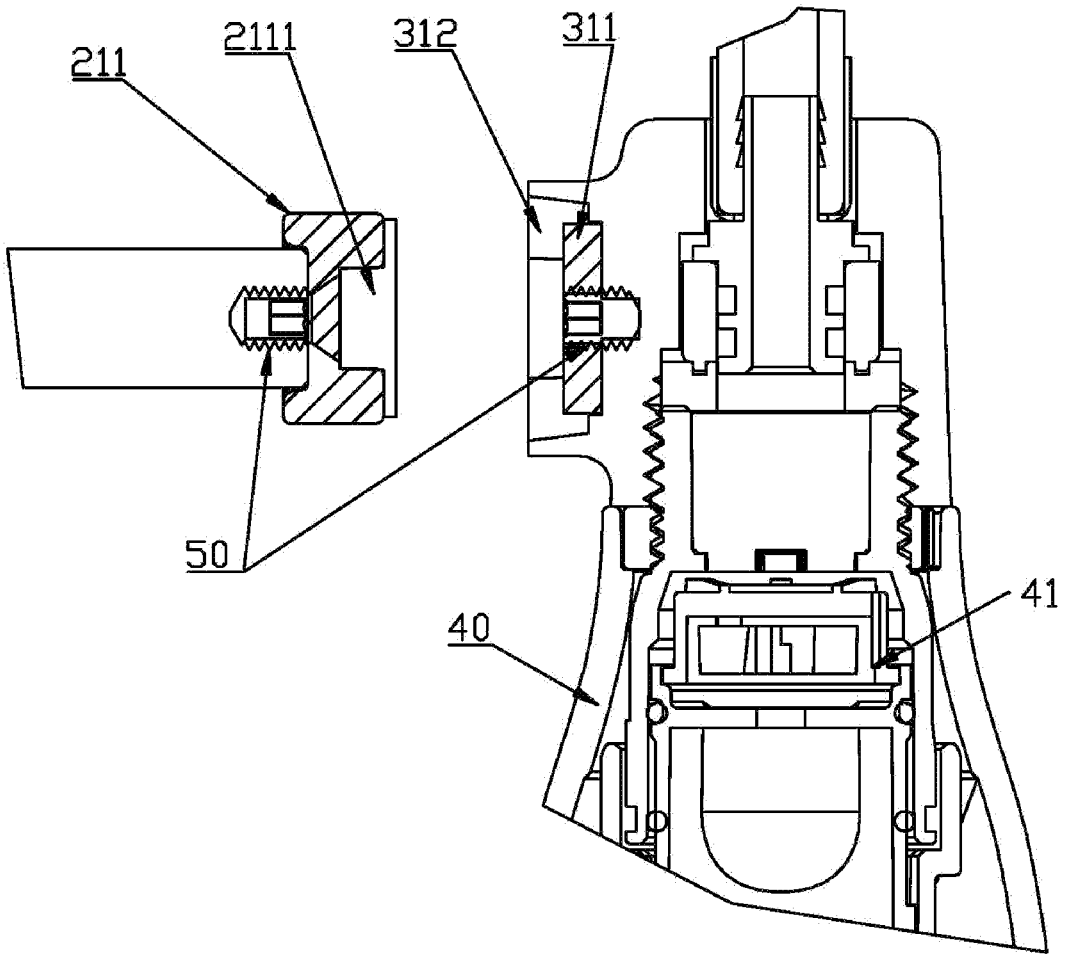
FIG. 3 is a sectional schematic diagram illustrating a water outflow pull head in a pulled state according to a first embodiment of the present utility model.

As shown in FIGS. 2-3, a cross rod 21 is mounted transversely on the faucet support bracket 20, and a magnet having a magnetism, i.e. a first magnetic attraction element 211, is mounted at a front end of the cross rod 21 through a screw 50. Furthermore, a second magnetic attraction element 311 is mounted at a side of the hose connector through a screw 50, and the second magnetic attraction element 311 has a magnetism opposite to the magnetism of the first magnetic attraction element 211. In order to reduce product costs, the second magnetic attraction element 311 may also be an iron element. Since the first magnetic attraction element 211 and the second magnetic attraction element 311 are under magnetic attraction, the cross rod 21 and the hose connector 31 may be connected magnetically.

Specifically, a first groove 2111 is inwardly formed along a radial direction in a middle portion of the first magnetic attraction element 211, a thread hole is opened at a bottom of the first groove 2111, and the screw 50 may be inserted through the thread hole to mate the first magnetic attraction element 211 with the cross rod 21 in a locked manner.

Specifically, a second groove 312 is inwardly formed at a side of the hose connector 31. In the first embodiment, an opening angle of the second groove relative to a horizontal direction is greater than 0 degree and smaller than 10 degrees, that is, the second groove is shaped into a horn having a large outer diameter and a small inner diameter.

Specifically, an outer diameter of the first magnetic attraction element 211 is smaller than an inner diameter of the second groove 312. When the water outflow pull head 40 returns to the cross rod 21, because the first magnetic attraction element 211 and the second magnetic attraction element 311 are under magnetic attraction and the second groove 312 is shaped like a horn, the second groove 312 can be easily fitted outside the first magnetic attraction element 211, thus achieving the returning and positioning of the water outflow pull head 40 on the cross rod 21. Because the two magnetic attraction elements are both made of hard materials, in order to avoid friction and damage between the hard materials and reduce collision noise under magnetic attraction, a rubber pad 212 is further disposed between the first magnetic attraction element 211 and the second magnetic attraction element 311. The rubber pad may be a soft silica gel pad. The rubber pad 212 may be embedded into the first groove 211 to ensure close mating and convenient mounting of parts.

Second Embodiment

Figure 4:
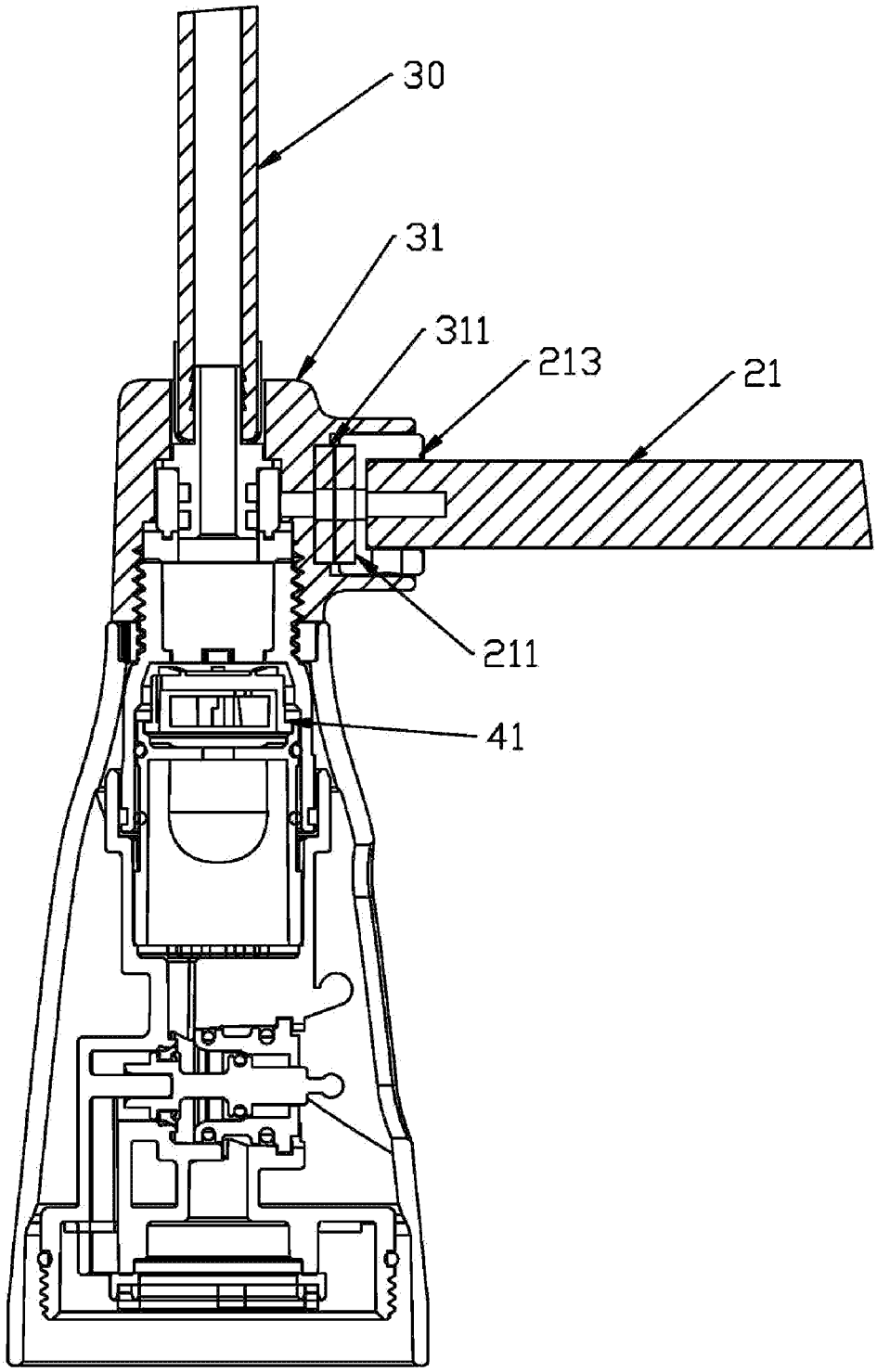
FIG. 4 is a sectional schematic diagram illustrating a water outflow pull head in a returned state according to a second embodiment of the present utility model.
Figure 5:
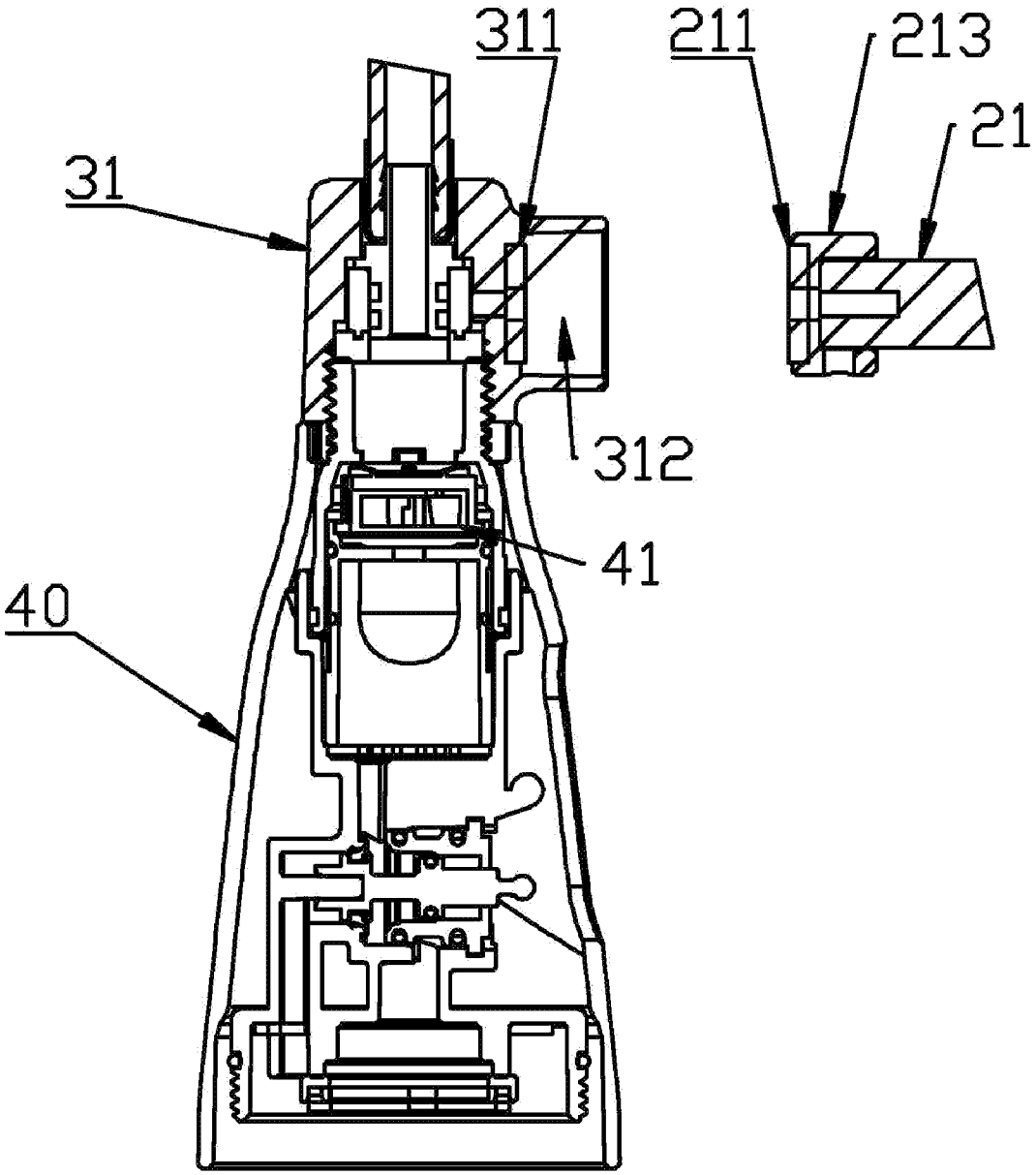
FIG. 5 is a sectional schematic diagram illustrating a water outflow pull head in a pulled state according to a second embodiment of the present utility model.

As shown in FIGS. 1, and 4-5, in the second embodiment of the present utility model, the opening angle of the second groove 312 located at a side of the hose connector 31 relative to a horizontal direction is 0 degree. Furthermore, a support seat 213 is fixedly mounted through a screw 50 between the first magnetic attraction element 211 and the cross rod 21, and the support seat 213 has an outer diameter smaller than the inner diameter of the second groove 312. When the water outflow pull head 40 returns to the cross rod 21, since the first magnetic attraction element 211 and the second magnetic attraction element 311 are under magnetic attraction, the second groove 312 can be easily fitted outside the support seat 213, thus achieving the returning and positioning of the water outflow pull head 40 on the cross rod 21.

In all of the above embodiments, a hydraulic generator 41, a temperature sensing element (not shown) and an LED lamp (not shown) are disposed inside the water outflow pull head 40. When water flow in the water supply hose 30 enters the water outflow pull head 40, the water flow passes through the hydraulic generator 41 to provide power to the LED lamp, and the temperature sensing element senses temperatures of the water flow and makes the LED lamp emit different colors, so as to provide water flows of different colors to a faucet operator. The faucet operator may determine whether the temperature of the water flow is high or not based on the color of the water flow, avoiding high temperature scald and bringing more comfortable and safer use experiences to the faucet operator.

Although the embodiments of the present utility model have been illustrated and described, those skilled in the art may understand that multiple changes, modifications, replacements and variations may be made to these embodiments without departing from the principle and spirit of the present utility model. The scope of protection of the present utility model is defined by the appended claims and its equivalents.

What is claimed is:

1. A magnetic pull-out faucet, comprising a faucet body, a faucet support bracket fixed on the faucet body and a water supply hose movable in the faucet body and the faucet support bracket, and a hose connector being disposed on a front end of the water supply hose and connected with a water outflow pull head, wherein the faucet support bracket is provided with a cross rod, the cross rod is provided with a first magnetic attraction element, the hose connector is provided with a second magnetic attraction element, the first magnetic attraction element is a magnet having a magnetism, the second magnetic attraction element is a magnet with a magnetism opposite to the first magnetic attraction element or an iron element magnetizable by the first magnetic attraction element, and the cross rod is mated with the hose connector in a magnetic attraction manner;

wherein the first magnetic attraction element is thread-mated with the cross rod; and a first groove is disposed in a middle portion of the first magnetic attraction element, and a thread hole is disposed at a bottom of the first groove, and a rubber pad is embedded inside the first groove.

2. The magnetic pull-out faucet of claim 1, wherein a second groove is disposed in the hose connector, the hose connector is connected with the cross rod through the second groove, and an opening angle of the second groove relative to a horizontal direction is 0-10 degrees.

3. The magnetic pull-out faucet of claim 1, wherein a hydraulic generator and a temperature sensing element are disposed inside the water outflow pull head.

4. The magnetic pull-out faucet of claim 3, wherein an LED lamp is further disposed inside the water outflow pull head.

5. A magnetic pull-out faucet, comprising a faucet body, a faucet support bracket fixed on the faucet body and a water supply hose movable in the faucet body and the faucet support bracket, and a hose connector being disposed on a front end of the water supply hose and connected with a water outflow pull head, wherein the faucet support bracket is provided with a cross rod, the cross rod is provided with a first magnetic attraction element, the hose connector is provided with a second magnetic attraction element, the first magnetic attraction element is a magnet having a magnetism, the second magnetic attraction element is a magnet with a magnetism opposite to the first magnetic attraction element or an iron element magnetizable by the first magnetic attraction element, and the cross rod is mated with the hose connector in a magnetic attraction manner, wherein the first magnetic attraction element is thread-mated with the cross rod; and wherein a support seat is disposed between the first magnetic attraction element and the cross rod, and the support seat is thread-mated with the first magnetic attraction element and the cross rod.

6. A magnetic pull-out faucet, comprising a faucet body, a faucet support bracket fixed on the faucet body and a water supply hose movable in the faucet body and the faucet support bracket, and a hose connector being disposed on a front end of the water supply hose and connected with a water outflow pull head, wherein the faucet support bracket is provided with a cross rod, the cross rod is provided with a first magnetic attraction element, the hose connector is provided with a second magnetic attraction element, the first magnetic attraction element is a magnet having a magnetism, the second magnetic attraction element is a magnet with a magnetism opposite to the first magnetic attraction element or an iron element magnetizable by the first magnetic attraction element, and the cross rod is mated with the hose connector in a magnetic attraction manner, wherein a second groove is disposed in the hose connector, the hose connector is connected with the cross rod through the second groove, and an opening angle of the second groove relative to a horizontal direction is 0-10 degrees; and wherein the second magnetic attraction element is disposed inside the second groove, a thread hole is disposed at a bottom of the second groove and the second magnetic attraction element respectively, and the second magnetic attraction element is thread-mated with the hose connector.

* * * * *